US006129249A

United States Patent [19]

Jacobsen et al.

[11] Patent Number: 6,129,249

[45] **Date of Patent: *Oct. 10, 2000**

[54] ACCESSORY FITTING USED WITH EQUIPMENT FOR FILLING SURFACE CRACKS

[76] Inventors: Kenneth H. Jacobsen, 921 N. Quentin Rd., Palatine, Ill. 60067; Louis F. Cole, 21233 Silk Tree Cir., Plainfield, Ill. 60544

[ * ] Notice: This patent is subject to a terminal disclaimer.

[21] Appl. No.: 09/392,752

[22] Filed: Sep. 7, 1999

Related U.S. Application Data

[63] Continuation of application No. 08/740,096, Jun. 8, 1993, Pat. No. 5,984,152.

[51] Int. Cl.[7] ..... B65D 5/72

[52] U.S. Cl. ..... 222/495; 222/575; 401/266; 425/12; 425/87

[58] Field of Search ..... 222/495, 559, 222/575; 401/107, 193, 266; 425/87, 12, 13; 156/94; 285/921

*Primary Examiner*—Philippe Derakshani

*Attorney, Agent, or Firm*—Charles F. Lind

[57] ABSTRACT

A material handling fitting consisting of a tube having inlet and outlet ends, with the tube being stepped between its ends and having a plurality of respectively opposed outer and inner land areas of progressively smaller to larger diameters from one of its ends to the other. The different respective outer and inner land areas are sized to correspond to and telescopically cooperate selectively with inner and outer land areas respectively of substantially conventional material dispensing members, over a wide range of sizes and types. Upon two of such members being telescoped simultaneously with the opposite fitting ends, separable leakproof joints can be established for defining a continuous passageway between the dispensing members via the fitting, suited for conveying therethrough material under pressure.

12 Claims, 2 Drawing Sheets

ACCESSORY FITTING USED WITH EQUIPMENT FOR FILLING SURFACE CRACKS

RELATED APPLICATION

This is a Continuation Application of application Ser. No. 08/740,096 filed on Oct. 24, 1996, now U.S. Pat. No. 5,566,866 issued on Oct. 22, 1996 and entitled COMBINATION PORT FOR SURFACE CRACK FILLING. The subject matter claimed in the accompanying Continuation Application was disclosed but not claimed in both the '096 application and in the same co-inventors' U.S. Pat. No. 5,566,866 issued on Oct. 22, 1996 from application Ser. No. 08/503,836 filed on Jul. 18, 1995. The two applications and patent are jointly and commonly owned by the same co-inventors.

FIELD OF THE INVENTION

This invention relates to devices usable for dispensing fluid material(s) via conventional dispensing outlet nozzle(s) directly into a surface crack of a structure, such as concrete floors, walls or ceilings.

BACKGROUND OF THE INVENTION

Caulk, adhesive, potting material and other fluid material systems are commonly contained in tubular cartridges of the type having an outlet nozzle at one end and an opposite open end that is closed by a wiper slidably seated against the inside face of the cartridge wall. The material is discharged from the outlet nozzle by advancing the wiper through the cartridge toward the nozzle. Available dispensing tools utilize a plunger connected to a rod, and a power device that forces the rod and plunger axially into the open cartridge end and against the wiper. Many dispensing tools are hand held and portable, where the power device is a ratchet mechanism indexed incrementally upon manual trigger squeezes.

Single component fluid material systems use only one cartridge, the material being discharged therefrom via an elongated dispensing tube having the outlet nozzle at its downstream end. Multiple component fluid material systems use different cartridges from which the materials are simultaneously discharged in the precise ratio need to form the intended composite material, the discharged materials being blended together in an elongated mixing/dispensing tube before being discharged as the composite material from the outlet end of the dispensing tube.

Common multiple component materials include two-part epoxies, urethanes, silicones, phenolics, acrylics and polyesters. Component fluid systems have been successfully used for filling surface cracks in concrete structures to restore structural integrity.

Special conduit routing structures can be fitted over the outlet end of the dispensing tube for more accurately directing the discharged material to the intended region of use. One such routing structure is a tubular surface port device, which has an outlet end with an enlarged base that can be bonded by adhesive to the structural surface with the tube bore aligned over a surface crack. The material dispensing tube is then seated against the inlet tube bore end to funnel the discharged material directly into the underlying crack.

Our U.S. Pat. No. 5,433,354 discloses a port device having great universality to operate effectively with many different types and sizes of dispensing tubes and outlet nozzles used in dispensing fluid material(s) from tubular cartridge(s), while maintaining a leakproof seated fit between the dispensing tube outlet nozzle and port device inlet, and possibly even without the need for physically holding these seated components together with any significant force. The port device tube has its inlet end stepped at adjacent axially extended inner land areas of progressively smaller diameters in the direction toward the outlet end, these land areas being sized so that at least one would snuggly receive at least one of the outer land areas provided on the different dispensing nozzles and/or tubes. These components when telescoped together establish the substantially leakproof and mechanically constrained connection for conveying the dispensed material. The flat base at the outlet end of the port device had side edges that could be flexed out of the flat, to position the device more closely adjacent an interior structural corner for directing material quite accurately into the corner.

Our copending application Ser. No. 08/503,836 discloses a port device specifically suited to discharge fluid material relative to a crack at a structural corner, either into an exterior corner or onto an exterior corner, with minimum material leaking beyond any underlying crack. Also, this port device can be fitted into a drilled hole or the structural crack itself and then manually secured and sealed relative thereto, suited for dispensing material under high pressure while yet withstanding blow-out from the structure. The application further shows accessory fittings for allowing universality of use of the port device, by establishing operative connections between the material dispensing tube and port device via flexible hoses of virtually any needed length, for dispensing fluid material into cracks spaced at variable distances and orientations from the dispensing tube and eliminating the need for the user to hold the dispensing tool close to and connected to the port device.

SUMMARY OF THE INVENTION

This invention relates to devices for establishing leakproof seated connections with great universality of use with many different types and sizes of dispensing tubes, nozzles, surface ports used in dispensing fluid material from cartridges, for directing such fluid material into cracks in underlying structures.

A basic object of this invention is to provide a low silhouette port device that can be connected to structure while having its throughbore aligned over a crack in said structure, and an accessory fitting that can be separably connected to the port device suited for dispensing material with little leakage into the structure crack and thereafter can be removed, leaving the port device behind but almost hidded on the structure. A closure plug can used with this port device to minimize leakage of the material from the opened throughbore before such sets.

Another basic object of this invention is to provide for use with material dispensing systems, an accessory fitting for allowing universality of use with different dispensing systems or material cartridges, with different mixing tubes, with different port devices and with varied possible different relative locations of such, by establishing operative separable connections between and via the fitting and the respective dispensing system or cartridge and/or mixing tube and/or port device and/or flexible hoses of virtually any needed length, for dispensing fluid material into cracks at variable distances and/or orientations between the material cartridges and cracks, eliminating the need for the user to hold the dispensing tool close to and connected to the port device.

Another object of this invention is to provide a port device accessory that can be used for dispensing fluid material under high pressures into the underlying crack, via a closure threaded onto the port device and a threaded pressure fitting of conventional design suited for being threaded into a tap or opening in the closure.

BRIEF DESCRIPTION OF THE DRAWINGS

These and further objects, advantages and features of the present invention will be understood and appreciated upon reviewing the following disclosure, including as a part thereof the accompanying drawings, in which.

DETAILED DESCRIPTION OF THE INVENTION

Figure 1:
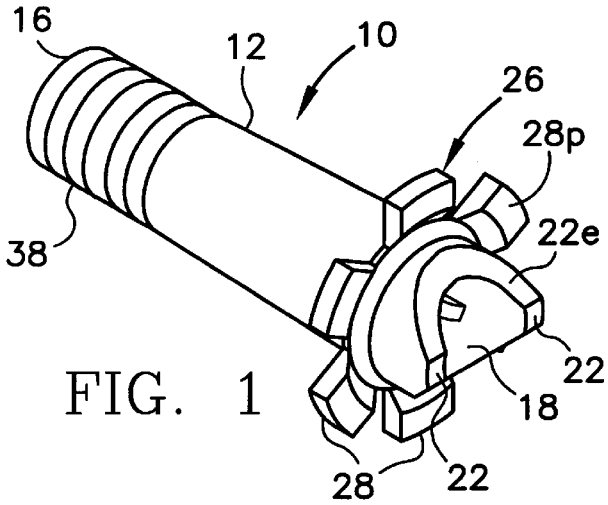
FIG. 1 is a perspective view of a port device according to this invention, as seen from the outlet end thereof.
Figure 2:
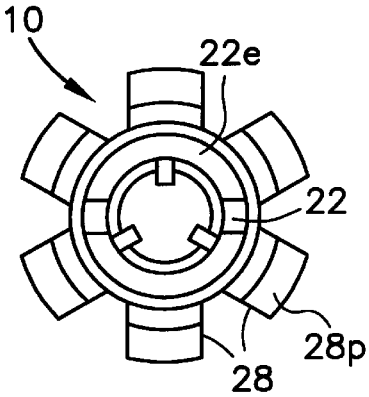
FIG. 2 is an elevational view of port device from the outlet end.
Figure 3:
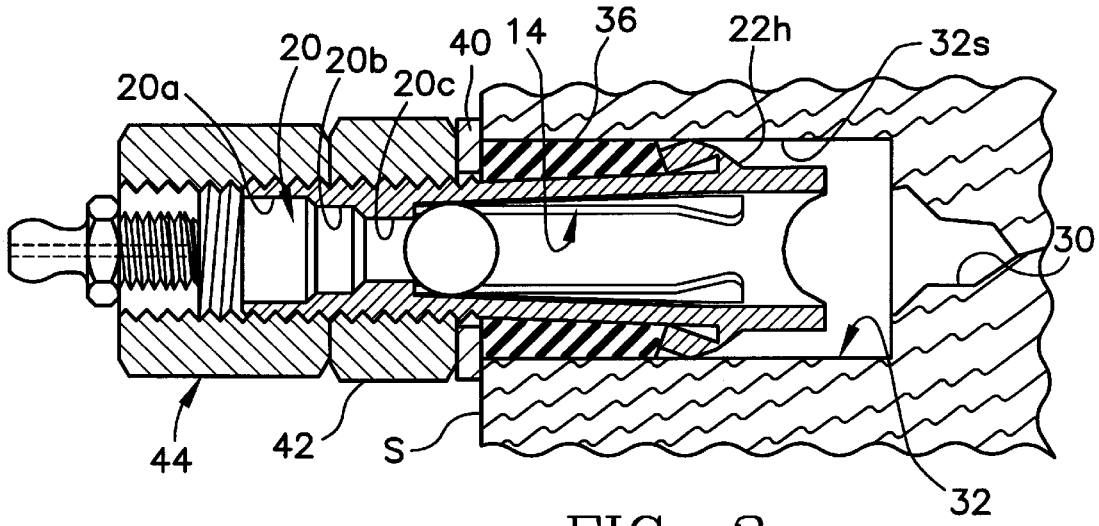
FIG. 3 is a centered sectional view of the port device, operatively in place in a structural crack.

A surface port device 10 is illustrated in FIGS. 1, 2 and 3, comprised as a tube 12 having a throughbore 14 between inlet end 16 and outlet end 18. The bore at the inlet end 16 has a stepped region 20, having three axially adjacent generally cylindrical inner diameter land areas 20*a*, 20*b*, and 20*c* of progressively smaller diameters in moving downstream toward the outlet end 18. The outlet end 18 illustrated has a protruding nose that is beveled from opposite centered high points 22, forming with tube end edges 22*e* a substantially right angle exterior corner. A mounting base 26 is formed on the tube 12 spaced from the outlet end nose and high points 22 in the direction of the inlet end 16; the base being comprised of separate radial blades 28 circumferentially disposed around the tube, and supported from the tube across generally circumferential hinged regions 28*h*. The blades are generally of rectangular shape, to be folded back to lie against the outside of the tube without having side edges of adjacent blades bind against one another; and six blades are illustrated.

With the blades unfolded, the blade pads 28*p* can be bonded or otherwise secured flush against a flat structural surface S, with the outlet nose fitted into a larger underlying crack; or the opposing blades can be folded part way back to have the pads lie flush against and be bonded to structural surfaces at an interior corner (not shown), when the end faces 22 are snugged against the structural surfaces at an interior corner for material discharge directly into an underlying crack with minimum leakage at the corner. A modified port device (not shown) could be provided without the outlet nose projecting beyond the plane of the unfolded blade pads 28*p*, allowing the port device to be bonded against a flat surface (not shown) and aligned over even a small surface crack. Our copending application Ser. No. 08/503,836 illustrates these alternatives.

As also illustrated in FIG. 3, port device 10 can effectively be used for high pressure material fill into a crack 30. This would be possible by drilling a hole 32 in the structure S to reach the crack and sized to accept the port device with the blade 28 folded back against the tube. A resilient sleeve 36 of rubber or plastic would be fitted over the tube 12, sized to fit into the hole and extended axially only part way along the tube to threaded region 38, and a washer 40 and nut 42 would be fitted over the tube inlet end. The tube and sleeve would be fitted into the hole 32 until the washer 40 and nut 42 are generally solid against the structure S, whereuon the nut would be tightened onto the tube at the threaded region to withdrawn the tube slightly and axially compress the sleeve 36 and expand it tightly against the hole surfaces of hole 32. This would withstand high discharging material pressures in excess of 1,000 psi. Further, a closure cap 44 having inside threads 45 is threaded onto tube threads 38, the cap also having an opening 46 that accepts a threaded pressure fitting 48 of conventional design. The opening 46 could be threaded, but the closure wall might be sufficiently thin to allow it to be self-threaded when threads 49 of the fitting 49 is twisted into the opening for securing it to the closure cap 44.

As discussed in our U.S. Pat. No. 5,433,354, the stepped inlet region 20 of the port device provides universality in snuggly cooperating with many different types and sizes of dispensing tubes and outlet nozzles used in dispensing fluid material(s) from tubular cartridge(s), and in thereby establishing a leakproof seated connection between the dispensing tube outlet nozzle and port device inlet. The diameters of the dispensing tubes vary, depending on the brand or supplier, and on the material being dispensed, its viscosity and needed rate of mixing and volume of discharge. By way of example, mixing tubes for multiple component systems typically might be of ¼, ⅜ or ½ inch I.D. or inner diameter and (because of the wall thickness of the tube) a correspondingly larger O.D. or outer diameter, and the outlet nozzle end of each such tube might be configurated as three, four or five smaller stepped cylindrical outer diameter nose sections; and the port stepped region 20 has the land areas 20*a*, 20*b* and 20*c* sized so that at least one of these stepped areas of the nose section can and do snuggly cooperate to establish the leakproof separable connection.

By way of specific example, the port device land area 20*a* can be of substantially 0.375 inch inner diameter with an axial length of substantially 0.185 inch, the land area 20*b* can be of substantially 0.25 inch inner diameter with an axial length of substantially 0.125 inch, and the land area 20*c* can be of substantially 0.165 inch inner diameter.

Figure 5:
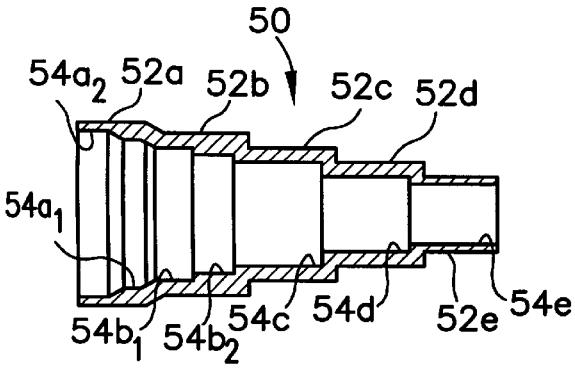
FIG. 5 is a centered section view of an accessory fitting usable with the surface port disclosed herein as well as with conventional material dispensing tools and systems.
Figure 4:
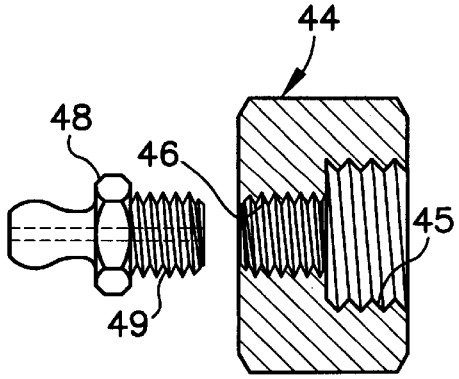
FIG. 4 is a broken away sectional view of components used in the port device of FIG. 3.

Adding to the universality of the port device is the enhanced fitting 50 of FIG. 5. The fitting 50 is tubular, having five stepped exterior land areas 52*a*, 52*b*, 52*c*, 52*d* and 52*e*, with corresponding interior land areas associated with each. The exterior land areas would be made to outer diameters respectively corresponding to the I.D. or interior diameter of different conventional flexible hoses: area 52*b* to snuggly receive a ⅝" hose, 52*c* to receive a ½" hose, 52*d* to receive a ⅜" hose, and 52*e* to receive a ¼" hose. The associated inner diameter land areas would be made to fit snuggly on the outer diameters respectively corresponding to the conventionally used mixing tubes, with axial length of each as needed for firm retention. This, would provide: land area 54*a*1 to snuggly fit over a ½" mixer tube; land areas 54*b*1 and 54*b*2 to snuggly fit over different types of ⅜" mixer tubes; land area 54*c* to snuggly fit over a ¼" mixer tube; land area 54*d* to snuggly fit over a 3/16" mixer tube, and land area 54*e* being the smallest throughbore of the tube.

Figure 6:
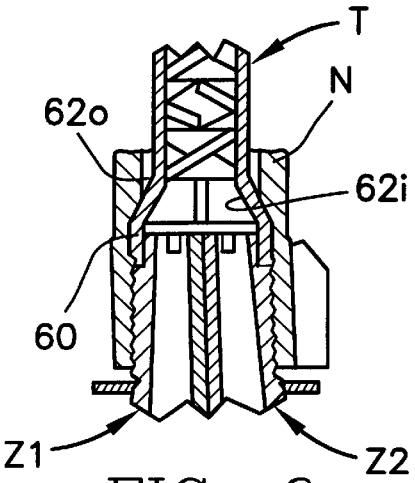
FIG. 6 is a centered section view of adjacent material cartridges illustrating a mixing tube secured over the adjacent outlet nozzles thereof.
Figure 7:
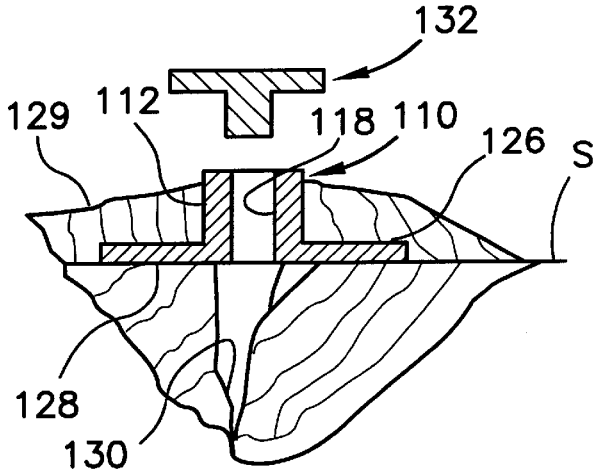
FIG. 7 is a centered section view of an alternative surface port mounted in place over a surface crack in a structure, with a closure plug also shown adjacent thereto but with the port yet open, suited for use with material dispensing fittings and systems disclosed herein.

Of further interest, land area 54*a*2 would be sized and shaped, including conically tapered interior and exterior faces 56*i* and 56*o*, to snugly fit over and cooperate with the outlet threaded stems or nozzles of conventional Bell housing material dispensing systems or machines and/or adjacent side-by-side material cartridges, where each cartridge has but a semi-cylindrical nozzle and under a retaining nut adapted to be connected onto the mixing tube, etc. FIG. 6 shows adjacent nozzles Z1 and Z2 from adjacent material cartridges (not shown) together that form a threaded stem, and a mixing tube T with a flared inlet end 60 having concially tapered interior and exterior faces 62*i* and 62*o*. The fitting faces 56*i* and 56*o* would correspond to these tube faces respectively, whereby such fitting can become secured to cartridge nozzles via nut N for discharge via the fitting and hoses or the like to remote end use points, as will be noted.

The fitting 50 is thus suited for connection and use directly onto the outlet threaded stems or nozzles of conventional Bell housing material dispensing systems or machines and/or adjacent side-by-side material cartridges, before the mixing tube, to provide for distribution of substantially unmixed materials via a hose to any spaced location and the connection then to the mixing tube for complete mixing of the material for dispensing into a nearby crack (not shown). Alternatively, the fitting can be positioned on and directly connected to the outside body of a material mixer, for connection via a hose to a separated surface port device for filling an underlying crack.

Of particular importance with this latter concept, the following port device 110 is being disclosed as a low cost but viable option of material fill. The port device 110 has plain circular base 126 and an upstanding central hub or short tube 112, and a bore 118 through both opening onto the bottom base surface 128. The port device is of a low silhouette, meaning that base is only approximately 1/16" thick and the tube 112 upstands therefrom between only ¼" and 5/16", leaving the bore possibly 5/16" or ⅜" long. The base surface 128 could be bonded to a structural surface S, but more likely would be held onto the surface by a layer 129 of epoxie, cement or the like overlying the base, while having the throughbore 118 aligned over a crack 130 in said structure. A closure 132 having a plug 133 that can be snugged into the bore 118 and having enlarged flange 134 for pressing and/or removing the plug, can used with this port device to prevent the epoxie layer 129 from entering the bore 118 while securing the port to the surface, or to minimize leakage from the opened bore of the fill material before such sets. An accessory fitting can be separably connected to the port device suited for dispensing material with little leakage into the structure crack and thereafter can be removed, leaving the port device behind but almost hidded under the layer 129 on the structure.

Figure 8:
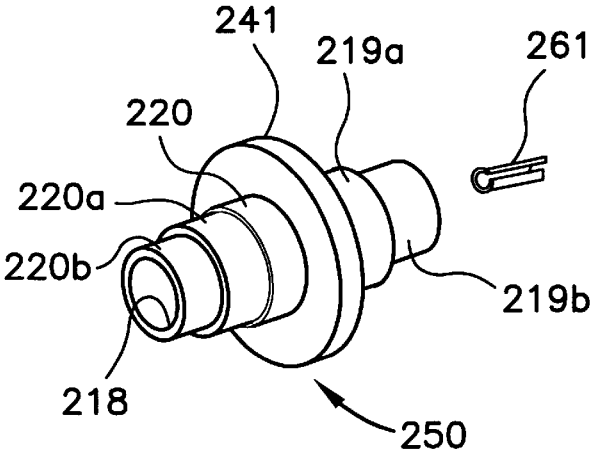
FIG. 8 is a perspective view of different accessory fitting.

The universality of the material dispensing system is further enhanced by fitting 250 illustrated in FIG. 8. The fitting 250 is tubular having two stepped outer land areas 219*a* and 219*b* to correspond to the inner land areas of different port devices or hoses, with outer land area 219*a* sized to mate with the bore 118 of port device 110. A throughbore 218 of generally uniform diameter is sized to accept the O.D of a small preferably ⅛" I.D hose. The exterior of the fitting 250 has outer land areas 220, 220*a* and 220*b*, which could be selectively mate with the inner land areas 20*a* and 20*b* of the port device 10 for establishing separable leakproof joints. As noted, the same outer land areas can be fitted into conventional small hoses used in the industry and clamped in place in a leakproof manner.

Thus, with either or both interior and/or exterior stepped land areas suited for receipt of and cooperation with the land areas of dispensing tubes and/or port devices, or for cooperating with the inside or outside of conventional hoses, the following assembly can be used with greatly improved ease and efficiency.

Figure 9:
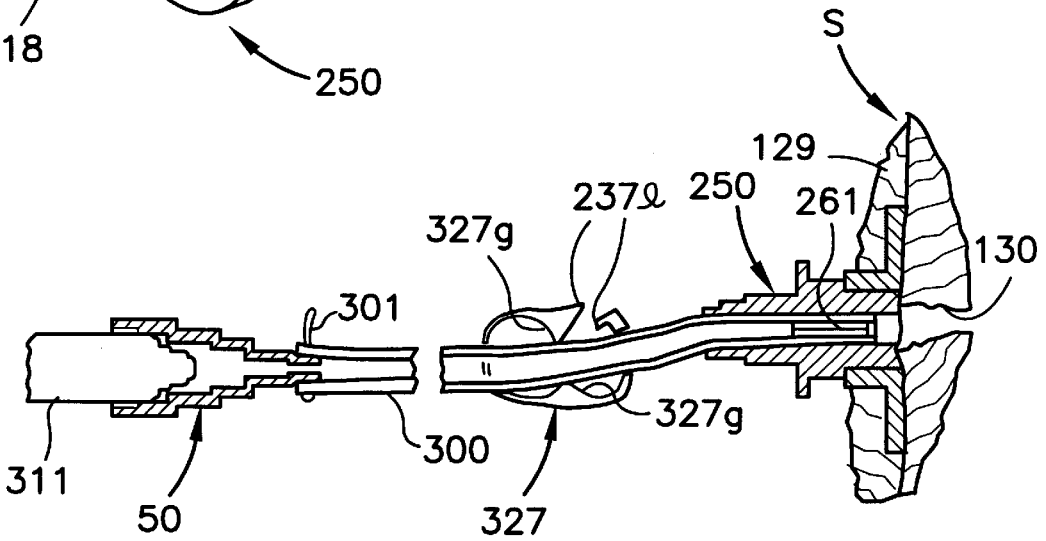
FIG. 9 is a sectional view of different accessory fittings illustrated in an operative connection between a mixing tube and a suitable port device, forming but one material dispensing system possible with the subject invention.

Thus, the fittings 50 and 250 could be connected to the opposite ends of a flexible hose 300, over the exterior land area 52*e* of fitting 50 and held mechanically thereon by a simple conventional spring clip 301, and within the bore 218 of fitting 250 and held mechanically therein by roll pin 261. Further, a conventional pinch clip 327 can be retained on the hose between the fittings, that in the opened position (illustrated in FIG. 9) allows material flow throught the hose; while when pinched closed with the grippers 327*g* clamped tightly against the hose to restrict and/or preclude material flow and with the latch areas 2371 engaged to retain the clip closed. Further, the land area 54*a*1 of the fitting 50 can be snugged on the outer diameter 311 of a ½" I.D. mixing tube T.

It would be possible to activate the pumping mechanism (not shown) for discharging the material through the mixing tube 311, and to control such flow by the pinch clip 327; and further to move the fitting 250 from one premounted port device 250 to another, for filling the same or different cracks quickly and without holding the cartridge tube(s).

Details of construction not given herein, are disclosed in our above-mentioned U.S. Pat. No. 5,433,354. This could include the check ball "B" held captive in the tube bore 14.

While only specific embodiments of the invention have been illustrated, it is apparent that variations may be made therefrom without departing from the inventive concept. Accordingly, the invention is to be limited only by the scope of the following claims.

What is claimed as our invention is:

1. An accessory fitting comprising the combination of, a tube having inlet and outlet ends, and a bore through the tube between the inlet and outlet ends;

the tube being stepped between its ends and having a plurality of respectively opposed outer and inner land areas of progressively smaller to larger diameters from one of its ends to the other of its ends; and said outer land areas being sized to correspond to and telescopically cooperate selectively with complementary inner land areas of certain respective dispensing members and said inner land areas being sized to correspond to and telescopically cooperate selectively with complementary outer land areas of certain other respective dispensing members, operable for establishing separable leakproof joints at its opposite ends on a universal basis with and between different sizes and types of conventional dispensing members in defining a continuous passageway between the dispensing members via the tube bore between its ends, suited for filling material under pressure into a surface crack of a structure.

2. A fitting according to claim 1, comprising the combination of the tube having at least four opposed outer and inner land areas between its ends.

3. A fitting according to claim 1, comprising the combination of the smallest opposed outer and inner land areas being respectively of the order of 7/17" and 5/16" diameters.

4. A fitting according to claim 1, comprising the combination of the largest opposed outer and inner land areas being respectively of the order of ⅝" and ½" diameters.

5. A fitting according to claim 1, comprising the combination of the tube having four opposed outer and inner land areas between its opposite ends, and the smallest opposed outer and inner land areas respectively being of the order of 7/17" and 5/16" diameters.

6. A fitting according to claim 1, comprising the combination of the tube having opposed outer and inner land areas between its opposite ends, and the largest opposed outer and inner land areas respectively being of the order of ⅝" and ½" diameters.

7. A fitting according to claim 1, comprising the combination of the tube having at least three opposed outer and inner land areas between its opposite ends, and two of such opposed outer and inner land areas respectively being of the order of 7/17" and 5/16" diameters and two others of such opposed outer and inner land areas respectively being of the order of ⅝" and ½" diameters.

8. A fitting according to claim 1, comprising the combination of axially adjacent outer land areas being respectively of the order of ⅝", ½" and ⅜" diameters, and the corresponding opposed inner land areas being respectively of the order of ½", ⅜" and ¼" diameters.

9. An accessory fitting comprising the combination of, a tube having inlet and outlet ends, and a bore through the tube between the inlet and outlet ends;

the tube being stepped between its ends and having at least four respectively opposed outer and inner land areas of progressively smaller to larger diameters from one of its ends to the other of its ends; and said axially adjacent outer land areas being sized of the order of ⅝", ½" and ⅜" diameters to correspond to and telescopically cooperate selectively with complementary inner land areas of certain respective dispensing members and said axially adjacent inner land areas being sized of the order of ½", ⅜" and ¼" diameters to correspond to and telescopically cooperate selectively with complementary outer land areas of certain other respective dispensing members, operable for establishing separable leakproof joints at its opposite ends on a universal basis with and between different sizes and types of conventional dispensing members in defining a continuous passageway between the dispensing members via the tube bore between its ends, suited for filling material under pressure into a surface crack of a structure.

10. An accessory fitting comprising the combination of, a tube having opposite ends and a bore through the tube between the opposite ends;

the tube having stepped regions between its opposite ends defining a plurality of respectively opposed generally cylindrical outer and inner land areas of progressively smaller to larger diameters from one of its ends to the other;

the tube also having at said other larger tube end a cylindrical region in excess of ½" interior diameter ending at a conically converging interior face suited to correspond to and telescopically cooperate with complementary threaded stem nozzles of conventional paired reactive material component cartridges; and said inner and outer land areas of the stepped regions being sized to correspond to and telescopically cooperate with complementary outer and inner land areas of material dispensing systems in the form of fitting, hose and/or mixer members, operable for establishing separable leakproof joints between its ends on a universal basis with and between different sizes and types of such conventional dispensing members in defining a continuous passageway between the dispensing members via the tube bore between its ends, suited for delivering material under pressure via the fitting.

11. A fitting according to claim 10, comprising the combination of the opposed cylindrical outer and inner land areas near the other larger end being respectively of the order of ⅝" and ½" diameters.

12. A fitting according to claim 11, comprising the combination of the tube having four opposed outer and inner land areas between its opposite ends.

* * * * *